US009290991B1

(12) United States Patent
McDill

(10) Patent No.: US 9,290,991 B1
(45) Date of Patent: Mar. 22, 2016

(54) BUILT IN HIDEAWAY STOOL

(71) Applicant: Dustin McDill, Edgemont, SD (US)

(72) Inventor: Dustin McDill, Edgemont, SD (US)

( * ) Notice: Subject to any disclaimer, the term of this patent is extended or adjusted under 35 U.S.C. 154(b) by 23 days.

(21) Appl. No.: 14/301,108

(22) Filed: Jun. 10, 2014

(51) Int. Cl.
*E06C 1/00* (2006.01)
*E06C 9/08* (2006.01)

(52) U.S. Cl.
CPC ..... *E06C 9/08* (2013.01)

(58) Field of Classification Search
CPC ..... E06C 1/005; A47C 12/02
See application file for complete search history.

(56) References Cited

U.S. PATENT DOCUMENTS 3,311,190 A * 3/1967 Naumann ..... 182/129
3,481,429 A * 12/1969 Gaede ..... 182/88
3,493,077 A * 2/1970 Doten ..... 182/96
3,756,678 A * 9/1973 Klopfenstein ..... 312/235.1
3,796,456 A * 3/1974 Bergeson et al. ..... 296/156
4,846,304 A * 7/1989 Rasmussen ..... 182/88
5,005,667 A * 4/1991 Anderson ..... 182/15
5,009,282 A * 4/1991 Willsher ..... 182/88
5,014,818 A 5/1991 Schulz
6,425,457 B1 * 7/2002 Lundry ..... 182/35
7,017,708 B1 * 3/2006 Lynn ..... 182/35
7,448,637 B2 * 11/2008 Parker ..... 280/166
2007/0144831 A1 * 6/2007 Cole ..... 182/33
2008/0264723 A1 * 10/2008 Tatum et al. ..... 182/35
2009/0188754 A1 * 7/2009 Warren et al. ..... 182/141
2015/0001005 A1 * 1/2015 Goodson ..... 182/96

* cited by examiner

*Primary Examiner* — Alvin Chin-Shue
*Assistant Examiner* — Candace L Bradford
(74) *Attorney, Agent, or Firm* — Crossley Patent Law

(57) ABSTRACT

A built in hideaway stool that provides hidden installation, such as under a cabinet or appliance, and when extended on its track and arms, rests a top step against an exterior wall of a stationary furniture item, such as a cabinet front side, to provide stable in-use step positioning.

1 Claim, 3 Drawing Sheets

BUILT IN HIDEAWAY STOOL

BACKGROUND OF THE INVENTION

Various types of collapsible stools are known in the prior art. However, what is needed is a built in hideaway stool that saves space, provides for rigid extended support by an exterior wall of a stationary furniture item such as a cabinet front side, and provides identical steps and rails and thereby ease the need to vary rail lengths and steps in manufacturing for lesser or greater height offerings of the stool.

FIELD OF THE INVENTION

The present invention relates to built in hideaway stool, and more particularly, to a built in hideaway stool that is supported in an in-use position by an exterior wall of a stationary furniture item, such as a cabinet front side.

SUMMARY OF THE INVENTION

The general purpose of the present built in hideaway stool, described subsequently in greater detail, is to provide a built in hideaway stool which has many novel features that result in a built in hideaway stool which is not anticipated, rendered obvious, suggested, or even implied by prior art, either alone or in combination thereof.

To accomplish this, the present built in hideaway stool includes a left outer track spaced apart from a right outer track, a left inner track slidably engaged within the left outer track, and a right inner track slidably engaged within the right outer track. A first plate is affixed to the left inner track. The first plate is disposed on an interior of and extended upwardly from the left inner track. The first plate is disposed most distally from the left outer track. A second plate is affixed to the right inner track. The second plate is disposed on an interior of and extended upwardly from the right inner track. The second plate is disposed most distally from the right outer track. A rounded edge is disposed on each of the first plate and the second plate. Each rounded edge is disposed most distally from the left outer track and the right outer track, respectively.

A first left arm is pivotally affixed on an interior of the first plate. The first left arm is disposed most proximal to the rounded edge. A second left arm is pivotally affixed on an interior of the first plate and is spaced apart from the first left arm. A first right arm is pivotally affixed on an interior of the second plate. The first right arm is disposed most proximal to the rounded edge. A second right arm is pivotally affixed on an interior of the second plate and spaced apart from the first right arm.

A first L-shaped step and a second L-shaped step are provided. The first and second L-shaped steps are identical. A pair of opposed outer edges is disposed on each of the first and second L-shaped steps. A pair of spaced apart inner L members is disposed within each of the first L-shaped step and the second L-shaped step, each inner L member disposed interiorly from and proximal to each outer edge, each inner L member having a horizontal leg and a down leg. Each of the first left arm and the first right arm is pivotally affixed to one of each of the down legs, respectively, each of the second left arm and the second right arm is pivotally affixed to one of each of the horizontal legs, respectively. The first L-shaped step is configured to be supported by an exterior wall of a stationary furniture item, such as a cabinet front side, when the first L-shaped step and the second L-shaped step are in a state of extension above the tracks and the first L-shaped step rests directly against the exterior wall.

In a stowed state, the inner tracks are slid as far into the outer tracks as needed, with the first and second arms substantially parallel with the tracks. In this state the stool is typically hidden from view underneath a structure such as a cabinet, appliance, or the like. Pulling the collapsed arms and steps outwardly from the stowed state provides for the first L-shaped step to be supported by the givens structure such that steps are then usable. Another advantage of the stool is that, in manufacture, tracks are lengthened, arms are extended and additional steps added to provide for a taller stool, especially as steps are identical.

Thus has been broadly outlined the more important features of the present built in hideaway stool so that the detailed description thereof that follows may be better understood and in order that the present contribution to the art may be better appreciated.

BRIEF DESCRIPTION OF THE DRAWINGS FIGURES

DETAILED DESCRIPTION OF THE DRAWINGS

Figure 1:
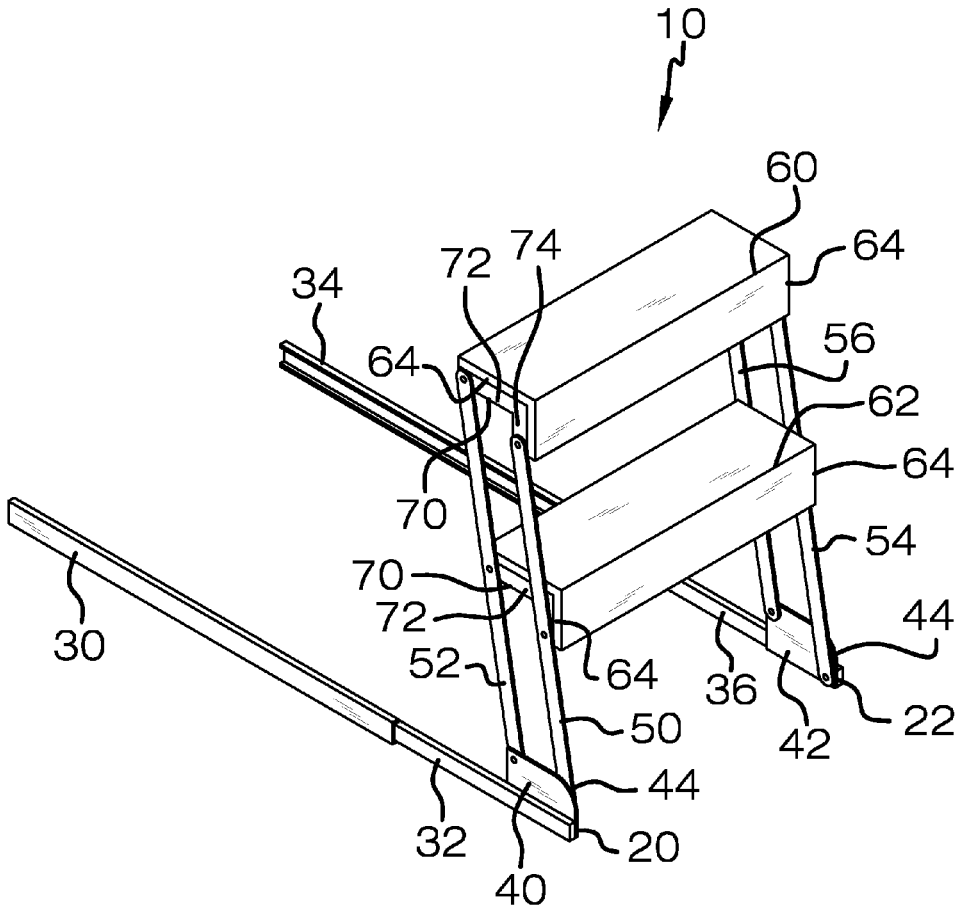
FIG. 1 is a left perspective view.
Figure 2:
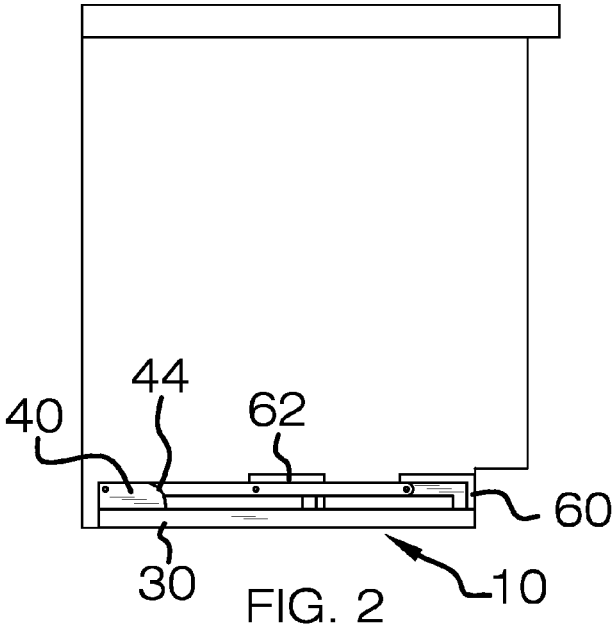
FIG. 2 is a left elevation view in a stored condition.
Figure 3:
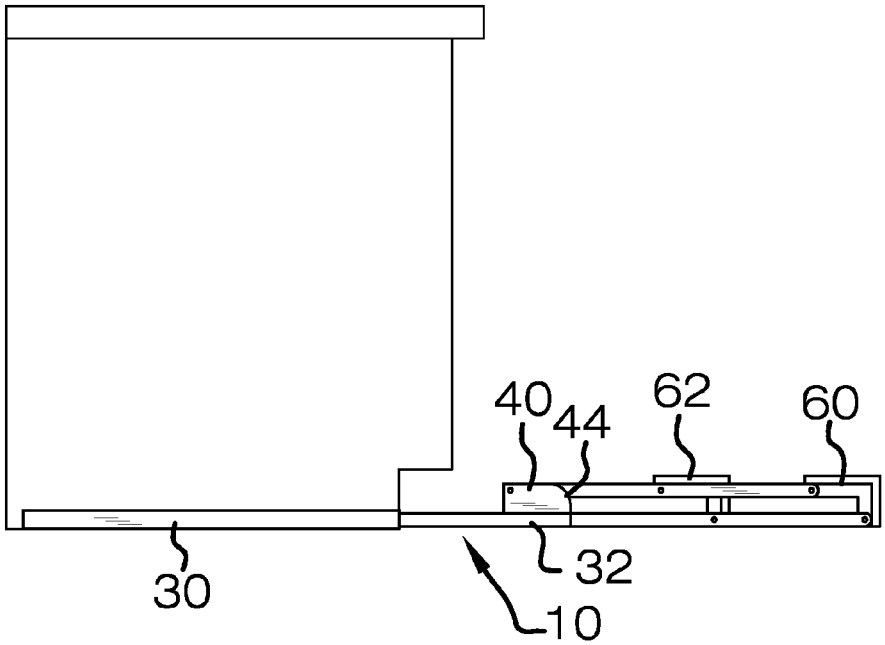
FIG. 3 is a left elevation view in a partially extended condition.
Figure 4:
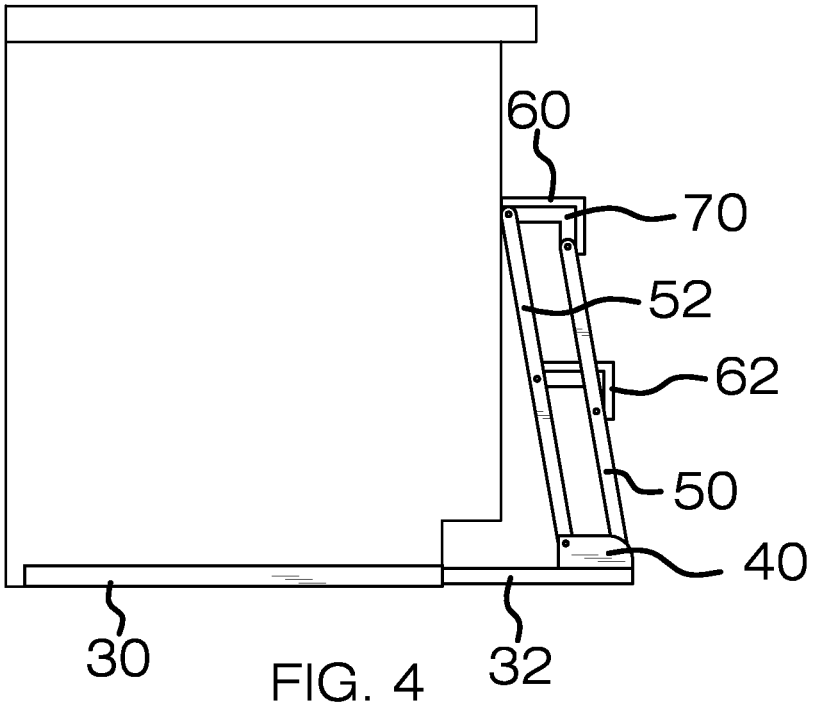
FIG. 4 is an in-use view.

With reference now to the drawings, and in particular FIGS. 1 through 4 thereof, an example of the built in hideaway stool employing the principles and concepts of the present built in hideaway stool and generally designated by the reference number 10 will be described.

Referring to FIGS. 1 through 4, the present built in hideaway stool 10 is illustrated. The built in hideaway stool 10 includes a left outer track 30 spaced apart from a right outer track 34, a left inner track 32 slidably engaged within the left outer track 30, and a right inner track 36 slidably engaged within the right outer track 34. A first plate 40 is affixed to the left inner track 32. The first plate 40 is disposed on an interior of and extended upwardly from the left inner track 32. The first plate 40 is disposed most distally from the left outer track 30. A second plate 42 is affixed to the right inner track 36. The second plate 42 is disposed on an interior of and extended upwardly from the right inner track 36. The second plate 42 is disposed most distally from the right outer track 34. A rounded edge 44 is disposed on each of the first plate 40 and the second plate 42. Each rounded edge 44 is most distal from the left outer track 30 and the right outer track 34, respectively.

A first left arm 50 is pivotally affixed on an interior of the first plate 40. The first left arm 50 is disposed most proximal to the rounded edge 44. A second left arm 52 is pivotally affixed on an interior of the first plate 40 and is spaced apart from the first left arm 50. A first right arm 54 is pivotally affixed on an interior of the second plate 42. The first right arm 54 is disposed most proximal to the rounded edge 44. A second right arm 56 is pivotally affixed on an interior of the second plate 42 and spaced apart from to the first right arm 54.

A first L-shaped step 60 is provided. A second L-shaped step 62 is provided and is identical to the first L-shaped step 60. A pair of opposed outer edges 64 is disposed on each first step 60 and each second step 62. A pair of spaced apart inner L members 70 is disposed within each of the first L-shaped step 60 and the second L-shaped step 62, each inner L member 70 disposed interiorly from and proximal to each outer edge, each inner L member having a horizontal leg 72 and a down leg 74. Each of the first left arm 50 and the first right arm 54 is pivotally affixed to one of each of the down legs 74, respectively. Each of the second left arm 52 and the second right arm 56 is pivotally affixed to one of each of the horizontal legs 72, respectively. The first and second left arms 50, 52 and the first and second right arms 54, 56 pivot toward the respective left outer track 30 and the second outer track 34. The first L-shaped step 60 is configured to be supported for stepping thereon in a stable in-use position by an exterior wall of a stationary furniture item, such as a cabinet front side, when the first L-shaped step 60 and the second L-shaped step 62 are in a state of extension above the tracks and the first L-shaped step 60 rests directly against the exterior wall.

What is claimed is:

1. A built in hideaway stool comprising:

a left outer track spaced apart from a right outer track;

a left inner track slidably engaged within the left outer track;

a right inner track slidably engaged within the right outer track;

a first plate affixed to the left inner track, the first plate disposed on an interior side of and extended vertically from the left inner track, the first plate disposed distally from the left outer track;

a second plate affixed to the right inner track, the second plate disposed on an interior side of and extended vertically from the right inner track, the second plate disposed distally from the right outer track;

a rounded edge disposed on each plate, each rounded edge most distal from the left outer track and the right outer track, respectively;

a first left arm pivotally affixed on an interior of the first plate, the first left arm disposed most proximal to the rounded edge;

a second left arm pivotally affixed on an interior of the first plate and spaced apart from the first left arm;

a first right arm pivotally affixed on an interior of the second plate, the first right arm disposed most proximal to the rounded edge;

a second right arm pivotally affixed on an interior of the second plate and spaced apart from the first right arm;

a first L-shaped step;

a second L-shaped step;

a pair of opposed outer edges disposed on each L-shaped step; and a pair of spaced apart inner L members disposed within each L-shaped step, each inner L member disposed interiorly from and proximal to each outer edge, respectively, each inner L member having a horizontal leg and a down leg;

wherein each first arm is configured to be pivotally affixed to one of each down leg, respectively, each second arm configured to be pivotally affixed to one of each horizontal leg, respectively; and wherein the first L-shaped step is configured to be supported for stepping thereon in a stable in-use position by an exterior wall of a stationary furniture item, such as a cabinet front side, when the first and second L-shaped steps are in a state of extension above the tracks and the first L-shaped step rests directly against the exterior wall.

* * * * *